US007017535B2

(12) United States Patent
Araki et al.

(10) Patent No.: US 7,017,535 B2
(45) Date of Patent: Mar. 28, 2006

(54) CARBURETOR FOR TWO-STROKE ENGINE

(75) Inventors: Satoru Araki, Kanagawa (JP); Kimio Koizumi, Kanagawa-ken (JP)

(73) Assignee: Zama Japan (JP)

( * ) Notice: Subject to any disclaimer, the term of this patent is extended or adjusted under 35 U.S.C. 154(b) by 63 days.

(21) Appl. No.: 10/834,315

(22) Filed: Apr. 27, 2004

(65) Prior Publication Data

US 2004/0244737 A1 Dec. 9, 2004

(30) Foreign Application Priority Data

May 28, 2003 (JP) ..... 2003-150420

(51) Int. Cl.
*F02B 75/02* (2006.01)

(52) U.S. Cl. ..... 123/65 A; 123/65 P

(58) Field of Classification Search ..... 123/65 A, 123/73 AA, 73 D, 65 R, 65 PD, 65 PE, 65 P
See application file for complete search history.

(56) References Cited

U.S. PATENT DOCUMENTS 6,354,251 B1 * 3/2002 Toda ..... 123/73 A
6,591,794 B1 * 7/2003 Toda ..... 123/73 A

FOREIGN PATENT DOCUMENTS

| | | | |
|---|---|---|---|
| JP | 9-268917 | | 10/1997 |
| JP | 1998-252565 | * | 9/1998 |
| JP | 1999-336613 | * | 12/1999 |
| JP | 2000-73869 | * | 3/2000 |
| JP | 2002-227653 | * | 8/2002 |

* cited by examiner

*Primary Examiner*—Bibhu Mohanty
(74) *Attorney, Agent, or Firm*—Orrick, Herrington & Sutcliffe LLP

(57) ABSTRACT

The present invention provides a carburetor that can be adapted to a variety of engines with different positional relationships between the location for feeding the air/fuel mixture and the location for feeding scavenging air. The carburetor a carburetor main body (22) with an air intake passage (24) forming a portion of the air/fuel mixture passage (23) and is provided with an air passage (33) that forms a portion of an air channel (32) for scavenging air. The air passage (33) is positioned parallel to an air intake passage (24), and the front end thereof is positioned further to the base end side than to the engine-side front end face of the carburetor main body (22), enhancing the degree of freedom for placing the conduit pipe (34) for connecting the air passage (33) to the scavenging air feed port (9). Also, the throttle valve (26) and the air valve (35) are butterfly valves with mutually parallel valve stems, and the interlocking mechanism thereof has a simple configuration.

8 Claims, 3 Drawing Sheets

Fig. 2
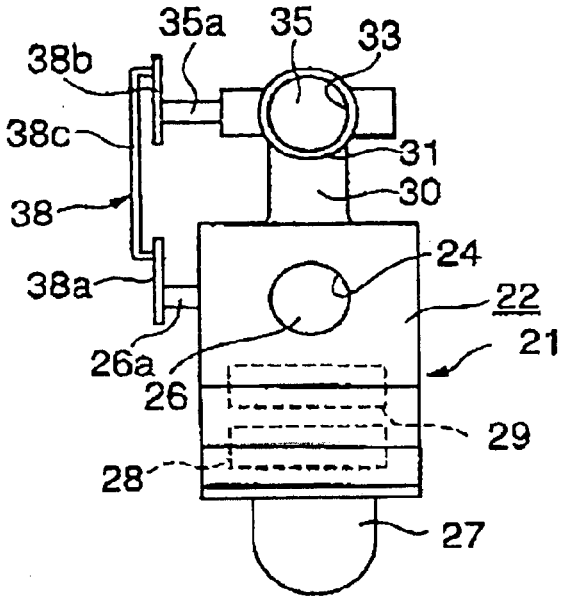
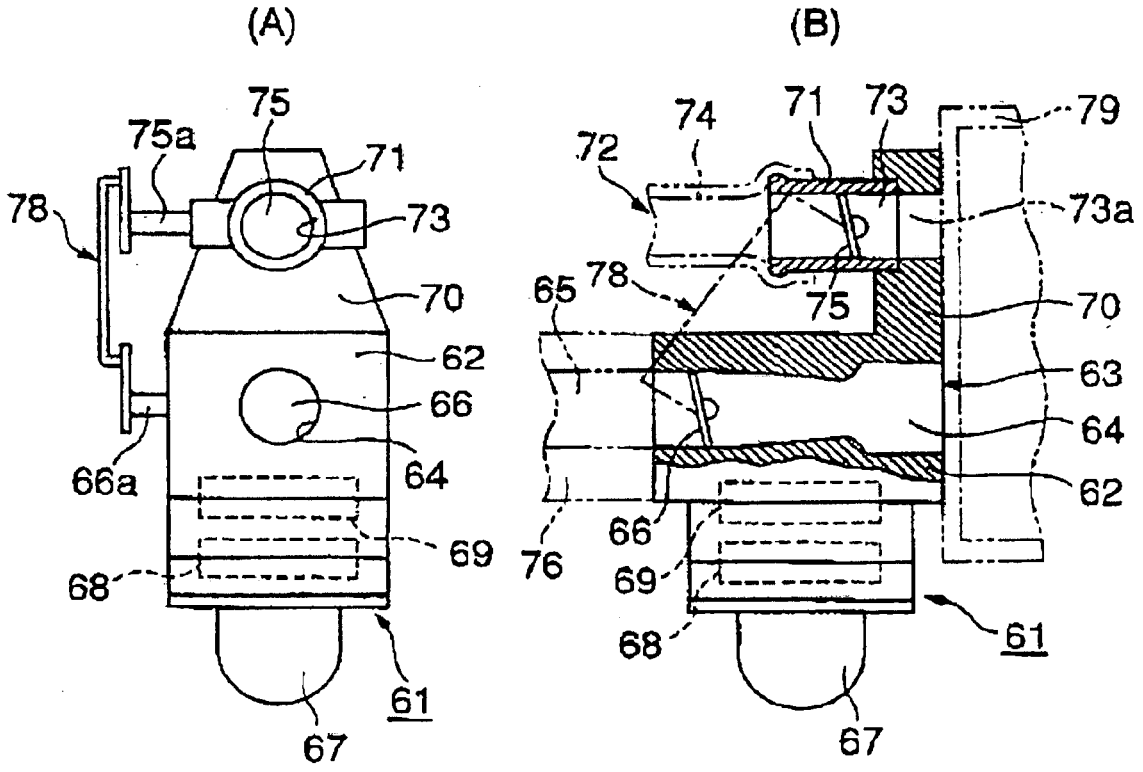
Fig. 3

CARBURETOR FOR TWO-STROKE ENGINE

FIELD OF THE INVENTION

The present invention relates to a carburetor for supplying fuel to a two-stroke engine in which scavenging air is introduced to the fuel chamber prior to an air/fuel mixture.

BACKGROUND OF THE INVENTION

There are two-stroke engines in which scavenging air is introduced to the combustion chamber during the downward stroke of the piston, and an air/fuel mixture is introduced to the combustion chamber after exhausting combustion gas. Known examples of these methods of introduction include feeding scavenging air to a scavenging channel connected to the crankcase and the fuel chamber, feeding an air/fuel mixture to the crankcase, and sequentially introducing these to the fuel chamber; directly introducing scavenging air to the fuel chamber, feeding an air/fuel mixture to the crankcase, and introducing the air/fuel mixture to the combustion chamber after the scavenging air; or directly introducing scavenging air and an air/fuel mixture in sequential fashion to the combustion chamber.

The flow rate of scavenging air and the air/fuel mixture must be made substantially proportional in order to prevent incomplete combustion, stabilize engine operation, and so forth; an air valve is therefore provided to the air channel for supplying scavenging air to the engine; and the air valve is operated in coordination with the throttle valve of the carburetor, which is a means for forming an air/fuel mixture.

This type of two-stroke engine is used as a power source for portable machinery and other small machines and, as a result, carburetors or air channels, air valves/throttle valve interlocking mechanisms, and other components must be installed in narrow locations requiring these components to be kept as small as possible.

Described in Japanese Patent Application Laid-open No. 10-252565 ('565 application) as a proposal for satisfying the above-described requirements is a configuration in which a carburetor with an air intake passage for forming a portion of the air/fuel mixture channel is provided with an air passage that forms a portion of the air channel and diverges from the air intake passage inlet portion. A throttle valve in the air intake passage and an air valve in the air passage are integrated in rotary configuration. The air intake passage is connected to the engine by way of a through hole provided to an adiabatic wall, and the air passage is connected to the engine by way of a conduit pipe.

Described in Japanese Patent Application Laid-open Nos. 11-336613 and 2000-73869 ('869 application) is a configuration in which the rotary air valve in the '565 application is substituted with a butterfly air valve that is integrated with the rotary throttle valve, and a conduit pipe forming a portion of the air channel is substituted with a through hole provided in the adiabatic wall.

Furthermore, described in Japanese Patent Application Laid-open No. 2002-227653 ('653 application) is a configuration in which a carburetor with an air intake passage for forming a portion of the air/fuel mixture channel is provided with a separate air passage for forming a portion of the air channel. Both the throttle valve in the air intake passage and the air valve in the air passage are fashioned as butterfly valves and are interlocked with each other by means of a linking mechanism. The air intake passage and the air passage are connected to the engine by way of a through hole and a conduit pipe that is provided to the adiabatic wall.

The carburetors in each of the applications described above are advantageous in that they are compact. The carburetors are compact because the air passage for forming a portion of the air intake channel is provided in parallel fashion to the air intake passage for forming a portion of the air/fuel mixture channel in the carburetor main body and because an air valve is disposed in the air passage. The carburetors are made further compact because the air valve and the throttle valve are integrated with each other and do not have interlocking mechanisms.

However, as noted in each of the above described applications, the carburetors are mounted in a predetermined location on the side face of the engine with an adiabatic wall interposed therebetween. For this reason, in a configuration in which the air passage, which is made to substantially the same length as the air intake passage, is connected from the back end thereof to a predetermined location in the engine by way of an external conduit pipe as in conventional systems, positioning the conduit pipe tends to be extremely difficult depending on the location for feeding scavenging air because the space between the carburetor main body and the engine is narrow. Described in Japanese Patent Application Laid-open No. 9-268917 ('917 application) is a configuration in which the air channel is made to diverge from the carburetor inlet portion from the air intake passage, and is connected to a predetermined position on the side face of the engine by way of an external conduit pipe. This configuration easily conforms to a variety of positional relationships between the location for feeding scavenging air and the location for feeding the air/fuel mixture in the engine because of the considerable freedom to place the conduit pipe. However, the carburetor of the '917 application is configured such that the throttle valve and the air valve are disposed at a right angle to each other, which complicates the interlocking mechanism and raises concerns that excessive force may be applied.

In the carburetors described in the '869 and '653 applications, the air passage and the air intake passage are connected to the engine by way of a conduit hole and a through hole formed in an adiabatic wall. Such carburetors can be used with only one type of engine, that is to say, with an engine in which a mutual match is established between the location for feeding the air/fuel mixture and the location for feeding scavenging air, and between the conduit hole and the through hole. Such carburetors are inapplicable to a large number of engines with differing positional relationships between the location for feeding the air/fuel mixture and the location for feeding scavenging air.

SUMMARY OF THE INVENTION

The present invention is directed to solving the above-stated problems. An object thereof is to provide a universal carburetor which can be used with a variety of engines, in which the interlocking mechanism for the throttle valve and the air valve is simple, and which can be easily mounted in narrow places.

The present invention provides a first device for solving the above-described drawbacks, wherein a carburetor main body with an air intake passage for forming a portion of an air/fuel mixture channel for feeding an air/fuel mixture to the engine is provided with an air passage for forming a portion of an air channel for feeding scavenging air to the engine. The air passage is mutually parallel with the air intake passage and comprises an air valve, and the front end thereof is positioned closer to the base end side than to the engine-side front end face of the carburetor main body. The air valve and a throttle valve disposed in the air intake passage are both butterfly valves, the valve stems thereof are mutually parallel, and the valves are operated in coordination with each other with the help of an interlocking mechanism to perform opening and closing action.

The present invention also provides a second device for solving the above-described drawbacks, comprising through holes in an adiabatic wall disposed between a carburetor main body and an air intake passage in the carburetor main body provided with an air/fuel mixture channel for feeding an air/fuel mixture to the engine. The device also comprising an air passage in the carburetor main body, which is also provided with an air channel for feeding scavenging air to the engine. The device further comprising a conduit pipe for connecting the air passage to the engine. The air passage is parallel with the air intake passage and comprises an air valve, and the front end thereof is positioned closer to the base end side than to the engine-side front end face of the carburetor main body. The air valve and a throttle valve disposed in the air intake passage are both butterfly valves, the valve stems thereof are mutually parallel, and the valves are operated in coordination with each other with the help of an interlocking mechanism to perform opening and closing action.

When the carburetor of the present invention is mounted on an engine with the location for feeding the air/fuel mixture connected to the air/fuel mixture channel, the space between the engine can be expanded because the front end of the air passage is positioned further to the base end side than to the engine-side front end face of the carburetor main body. As a result, the freedom in placing the conduit pipe for connecting the air passage to the location for feeding scavenging air is increased, and the arrangement can be adapted to a variety of engines with different positional relationships between the location for feeding the air/fuel mixture and the location for feeding scavenging air. Also, the throttle valve and the air valve are butterfly valves and the valve stems are parallel, so the interlocking mechanism is simple, the freedom in placing the conduit pipe is considerable, and placement in narrow places is facilitated.

Other systems, methods, features and advantages of the invention will be or will become apparent to one with skill in the art upon examination of the following figures and detailed description.

BRIEF DESCRIPTION OF THE DRAWINGS

FIG. 2 is a view of the left-hand side of the carburetor of FIG. 1.

FIG. 3 includes views of a second embodiment of the present invention, wherein (A) is a view of the left-hand side, and (B) is a longitudinal section.

DETAILED DESCRIPTION OF THE PREFERRED EMBODIMENTS

Figure 1:
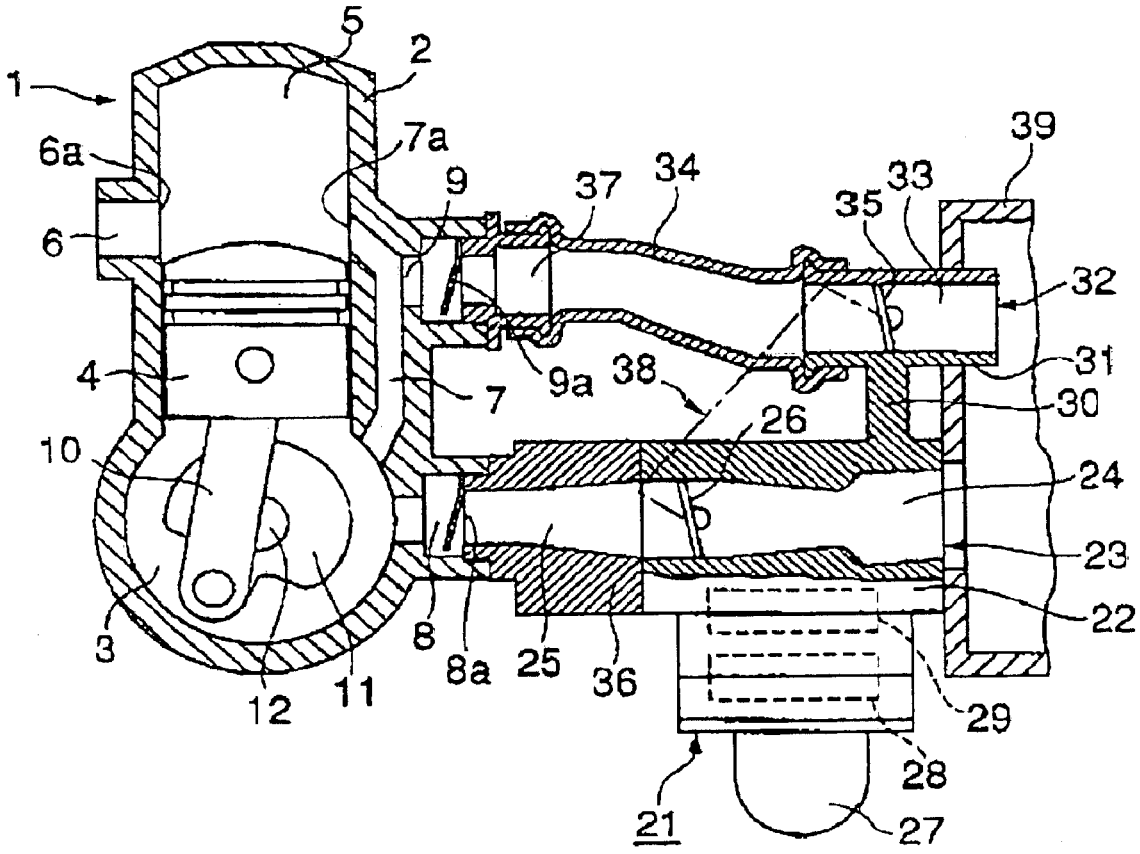
FIG. 1 is a longitudinal section of the carburetor related to the first embodiment of the present invention mounted on an engine.

Describing the embodiments of the present invention with reference to the diagrams, FIG. 1 is a longitudinal section in which the carburetor 21 related to the first embodiment of the present invention is mounted on a stratified scavenging two-stroke engine 1. The engine 1 has a cylinder 2, a crankcase 3, and a piston 4. A scavenging port 7*a*, which is the outlet of a scavenging channel 7, which links the crankcase 3, an exhaust port 6*a* as an inlet of an exhaust channel 6, and a combustion chamber 5 above the piston 4, opens to the cylinder 2. Also, an air/fuel mixture feed port 8 with a check valve 8*a* opens to the crankcase 3, and a scavenging air feed port 9 with a check valve 9*a* opens to a location near the scavenging port 7*a* in the scavenging air channel 7.

When the piston 4 begins to ascend from the bottom dead center, the crankcase 3 increases in capacity and the piston 4 closes the exhaust port 6*a* and the scavenging port 7*a*. The pressure in the crankcase 3 and the scavenging channel 7 consequently decreases, an air/fuel mixture is fed from the air/fuel mixture feed port 8 to the crankcase 3, and scavenging air is fed from the scavenging air feed port 9 to the scavenging channel 7 and the crankcase 3.

When the piston 4 nearly reaches the top dead center, the air/fuel mixture introduced to the combustion chamber 5 in a prior step ignites and combusts, and when the piston 4 then begins to descend, the pressure in the crankcase 3 increases. At the same time, the exhaust port 6*a* and the scavenging port 7*a* open to expel the exhaust gas in the combustion chamber 5 into the exhaust channel 6. The scavenging air in the scavenging channel 7 is introduced to the combustion chamber 5 from the scavenging port 7*a* to expel the remaining combustion gas. The air/fuel mixture in the crankcase 3 subsequently passes through the scavenging air channel 7 and into the combustion chamber 5, and the piston 4 reaches the bottom dead center.

Due to the above-described repetition, the crankshaft 12 coupled to the linearly reciprocating piston 4 by way of a connecting rod 10 and a crank arm 11 rotates in the same manner as a conventional two-stroke engine.

Next, the carburetor 21 related to the first embodiment of the present invention shown in FIGS. 1 and 2 comprises mutually overlapping manual start pump 27 on the lower surface of the carburetor main body 22 with a horizontally extending air intake passage 24, pulsating diaphragm fuel pump 28 operated as a result of the pulsating pressure of the crankcase 3, and diaphragm fuel metering mechanism 29 that acts so as to continuously ensure that a constant quantity of fuel is delivered to the air intake passage 24.

A rod-shaped or plate-shaped arm 30 that extends upward is coupled to the upper surface of the base end portion of the carburetor main body 22 and a tubular piece 31 is coupled to the upper end of the arm 30. The arm 30 and tubular piece 31 are fashioned into an integrally molded component.

The carburetor 21 of the present embodiment is mounted on the engine 1 via an interposed adiabatic wall 36 that is overlaid on the front end face of the carburetor main body 22. The air intake passage 24 and a through hole 25 provided in the adiabatic wall 36 are positioned on the same center axis line to form an air/fuel mixture channel 23. The air/fuel mixture channel 23 is linked to the air/fuel mixture feed port 8, and the front end of the adiabatic wall 36 is fitted into the entrance end of the air/fuel mixture feed port 8.

The base end of the tubular piece 31 is positioned further rearward from the base end face of the carburetor main body 22, the front end thereof is positioned further to the base end side than to the front end face of the carburetor main body 22, and the inside thereof forms an air passage 33 that extends parallel to the air intake passage 24. A tubular joint 37 is mounted on the entrance end of the scavenging air feed port 9. The front end of the tubular piece 31 and the tubular joint 37 are conjoined by a flexible conduit pipe 34. The tubular joint 37, feed port 9, and tubular piece 31 form a scavenging channel 32 for feeding scavenging air to the engine 1.

The output-controlling throttle valve 26 provided to the air intake passage 24, and the air valve 35 designed for controlling the flow rate of scavenging air and provided to the air passage 33 are both butterfly valves. The valve stems 26*a* and 35*a* of these valves 26 and 35 extend parallel to each other in the horizontal direction; and open and close in coordination with the help of an interlocking mechanism 38. The interlocking mechanism 38 comprises levers 38*a* and 38*b* mounted on the stem ends thereof and a linking rod 38*c* by which the levers 38*a* and 38*b* are linked.

An air cleaner 39 is overlaid on the base end face of the carburetor main body 22, the base end of the tubular piece 31 protrudes into the interior thereof, and the air/fuel mixture channel 23 and the air channel 32 are individually linked to the air cleaner 39 and are supplied with air.

According to the present embodiment, the carburetor main body 22 is mounted close to the engine 1 on the other side of the adiabatic wall 36. The space formed by the scavenging air feed port 9 of the engine 1 is considerable because the front end of the air passage 33 is positioned substantially in the center above the carburetor main body 22. Hence, the flexible conduit pipe 34 can be coupled with these without excessive bending even if the scavenging air feed port 9 is positioned above the extended center shaft line of the air passage 33.

According to the present embodiment, the interlocking mechanism 38 is a simple structure, can be disposed in narrow places, and can be smoothly linked without concern of causing damage or malfunctioning due to the application of excessive force because the throttle valve 26 and the air valve 35 are both butterfly valves, the valve stems 26*a* and 35*a* thereof rotate without moving in the direction of the center shaft line, and the valve stems 26*a* and 35*a* are parallel to each other.

Figure 4:
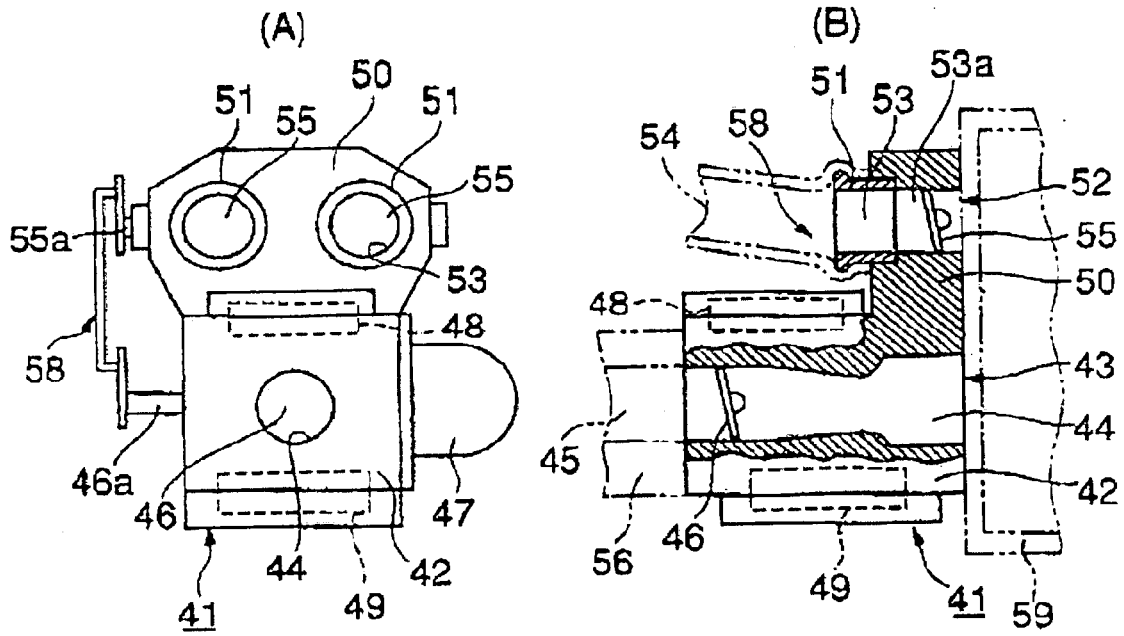
FIG. 4 includes views of a third embodiment of the present invention, wherein (A) is a view of the left-hand side, and (B) is a longitudinal section.

FIGS. 4(A) and (B) depict a second embodiment of the carburetor of the present invention. The carburetor 41 comprises a manual starter pump 47 on one side of the carburetor main body 42 with a horizontally extending air intake passage 44, a pulsating diaphragm fuel pump 48 disposed on the upper face and operated as a result of the pulsating pressure of the crankcase, and a diaphragm fuel metering mechanism 49 on the lower face that acts so as to ensure that a constant quantity of fuel is continuously delivered to the air intake passage 44.

A wall piece 50 in the form of a flat plate protruding upward above the base end portion of the carburetor main body 42 is aligned and integrally molded with the same surface as the base end face.

The carburetor 41 of the present embodiment is also mounted on the engine 1 with an interposed adiabatic wall 56 that is overlaid on the front end face of the carburetor main body 42. The air intake passage 44 and a through hole 45 provided in the adiabatic wall 56 are positioned on the same center axis line to form an air/fuel mixture channel 43, and are connected to the air/fuel mixture feed port of the engine.

Here, the carburetor 41 of the present embodiment is coupled to an engine comprising two scavenging air channels individually fed with scavenging air. Two inlets 53*a* are disposed adjacent to each other and parallel to the air intake passage 44, tubular joints 51 comprising short pipes are mounted on the front ends of the inlets 53*a* and made to protrude forward from the wall piece 50, and the inlets 53*a* and tubular joints 51 form air passages 53. The tubular joints 51 couple with a flexible conduit pipe 54 connected to the scavenging air feed port of the engine, and the inlets 53*a*, tubular joints 51, and conduit pipe 54 form an air channel 52 for feeding scavenging air to the engine.

The output-controlling throttle valve 46 provided to the air intake passage 44, and the air valves 55 designed for controlling the flow rate of scavenging air and provided to the inlets 53*a* of the air passages 53 are each butterfly valves. The valve stems 46*a* and 55*a* of the throttle valve 46 and air valve 55 are mutually parallel and extend in the horizontal direction. The valves operate in coordination with each other with the help of the same interlocking mechanism 58 as the embodiment depicted in FIGS. 1 and 2 to perform opening and closing action. The two air valves 55 have the same valve stem 55*a*. The air cleaner 59 is overlaid on the base end faces of the carburetor main body 42 and the wall piece 50, and the interior thereof is linked individually to the air/fuel mixture channel 43 and the air channel 52.

In the present embodiment, the front ends of the tubular joints 51 are positioned substantially in the center above the carburetor main body 42, so an interlocking mechanism such as a fuel pump 48 can be mounted without any trouble on the upper face toward the front of the wall piece 50 of the carburetor main body 42, and the space formed by the scavenging air feed port is considerable in the same manner as in the embodiment depicted in FIGS. 1 and 2, so the conduit pipe 54 can be coupled without excessive bending. Furthermore, the same effects as in FIGS. 1 and 2 can be obtained in that the interlocking mechanism 58 is also a simple structure, can be disposed in narrow places, and can be smoothly linked without application of excessive force.

FIGS. 3(A) and (B) show a third embodiment of the carburetor of the present invention. The carburetor 61 is obtained as a result of the mutual overlapping of a manual starter pump 67, a fuel pump 68, and a diaphragm fuel metering mechanism 69 in the same manner as in the first working embodiment on the lower face of the carburetor main body 62 with a horizontally extending air intake passage 64. A wall piece 70 in the form of a flat plate protruding upward above the base end portion of the carburetor main body 62 is aligned and integrally molded with the same surface as the base end face.

The carburetor 61 of the present embodiment is also mounted on the engine with an interposed adiabatic wall 76 that is overlaid on the front end face of the carburetor main body 62. An air intake passage 64 and a through hole 65 provided in the adiabatic wall 76 are positioned on the same center axis line to form an air/fuel mixture channel 63, and are connected to the air/fuel mixture feed port of the engine.

The wall piece 70 has a single inlet 73*a* in parallel with the air intake passage 64. A tubular joint 71 comprising a short pipe is fixedly inserted into the front end of the inlet 73*a* and made to protrude forward from the wall piece 70. The inlet 73*a* and the tubular joint 71 form an air passage 73. The tubular joint 71 couples with a flexible conduit pipe 74 connected to the scavenging air feed port of the engine. The inlet 73*a*, tubular joint 71, and conduit pipe 74 form an air channel 72 for feeding scavenging air to the engine.

The output-controlling throttle valve 66 provided to the air intake passage 64, and the air valve 75 designed for controlling the flow rate of scavenging air and provided in the tubular joint 71 are both butterfly valves. The valve stems 66*a* and 75*a* of the throttle valve 66 and air valve 75 are mutually parallel and extend in the horizontal direction. The valves are operated in coordination with each other with the help of the same interlocking mechanism 78 as in the first and second embodiments to perform opening and closing action. The air cleaner 79 is overlaid on the base end face of the carburetor main body 62 and the wall piece 70, and the interior thereof is linked individually to the air/fuel mixture channel 63 and the air channel 72.

In the present embodiment as well, the front end of the tubular joint 71 is positioned substantially in the center above the carburetor main body 62, so the space formed by the scavenging air feed port is considerable in the same manner as in the first and second embodiments, and the conduit pipe 74 can be coupled without excessive bending. Furthermore, the same effects as in the first and second embodiments can be obtained in that the interlocking mechanism 78 also has a simple structure, can be disposed in narrow places, and can be smoothly linked without application of excessive force.

The present invention may also be adapted to situations in which the air intake passages 24, 44, and 64 and the air passages 32, 52, and 72 have a horizontal relationship rather than a vertical relationship, or to situations in which the valve stems 26*a*, 35*a*, 46*a*, 55*a*, 66*a*, and 75*a* are disposed in a diagonal direction rather than a horizontal direction. Also, the arm 30, the short tubular piece 31, and the wall pieces 50 and 70 may be separately fabricated and fixed together rather than integrally molded with the carburetor main bodies 22, 42, and 62.

As described above, the carburetor of the present invention allows an air passage for feeding scavenging air, and an interlocking mechanism between the throttle valve and air valve to be easily mounted in narrow locations in a variety of engines with different positional relationships between the location for feeding the air/fuel mixture and the location for feeding scavenging air.

In the foregoing specification, the invention has been described with reference to specific embodiments thereof. It will, however, be evident that various modifications and changes may be made thereto without departing from the broader spirit and scope of the invention. For example, each feature of one embodiment can be mixed and matched with other features shown in other embodiments. Features and processes known to those of ordinary skill may similarly be incorporated as desired. Additionally and obviously, features may be added or subtracted as desired. Accordingly, the invention is not to be restricted except in light of the attached claims and their equivalents.

What is claimed is:

1. A carburetor for a two-stroke engine, comprising:

a carburetor main body, an air intake passage in the carburetor main body forming a portion of an air/fuel mixture channel for feeding an air/fuel mixture to the engine, an air passage for forming a portion of an air channel for feeding scavenging air to the engine, the air passage is mutually parallel with the air intake passage and comprises an air valve, the air valve and a throttle valve disposed in the air intake passage are operated in coordination with each other through an interlocking mechanism to perform opening and closing action, and a fuel pump and a fuel metering mechanism mutually overlapping on one side of the carburetor main body.

2. The carburetor for a two-stroke engine according to claim 1, further comprising a start pump overlapping the fuel pump and fuel metering mechanism.

3. The carburetor for a two-stroke engine according to claim 1, wherein a front end of the air passage is positioned closer to a base end side of the carburetor main body than to the engine-side front end face of the air intake passage of the carburetor main body.

4. The carburetor for a two-stroke engine according to claim 1, wherein the air passage is formed from a tubular piece provided to an arm that protrudes from the carburetor main body.

5. The carburetor for a two-stroke engine according to claim 1, wherein the air passage comprises an inlet provided to a wall piece that protrudes from the carburetor main body, and a tubular joint mounted on the front end thereof and made to protrude forward from the wall piece.

6. The carburetor for a two-stroke engine according to claims 1, wherein the air passage comprises an inlet provided to a wall piece that protrudes from the carburetor main body, and a tubular joint mounted on the front end thereof and made to protrude forward from the wall piece.

7. The carburetor for a two-stroke engine according to claim 6, wherein the air valve is mounted in the inlet.

8. The carburetor for a two-stroke engine according to claim 6, wherein the air valve is mounted in the tubular joint.

* * * * *